US010363195B2

(12) United States Patent
Raines et al.

(10) Patent No.: US 10,363,195 B2
(45) Date of Patent: Jul. 30, 2019

(54) DEVICES AND METHODOLOGIES FOR PHYSICAL THERAPY AND WELL BEING

(71) Applicants: Cosmo Mark Raines, Austin, TX (US); Christie Powell, Austin, TX (US)

(72) Inventors: Cosmo Mark Raines, Austin, TX (US); Christie Powell, Austin, TX (US)

( * ) Notice: Subject to any disclaimer, the term of this patent is extended or adjusted under 35 U.S.C. 154(b) by 208 days.

(21) Appl. No.: 14/217,421

(22) Filed: Mar. 17, 2014

(65) Prior Publication Data

US 2014/0350443 A1 Nov. 27, 2014

Related U.S. Application Data

(60) Provisional application No. 61/802,040, filed on Mar. 15, 2013, provisional application No. 61/786,399, filed on Mar. 15, 2013, provisional application No. 61/786,468, filed on Mar. 15, 2013.

(51) Int. Cl.
*A61H 15/00* (2006.01)

(52) U.S. Cl.
CPC ... *A61H 15/0092* (2013.01); *A61H 2015/005* (2013.01); *A61H 2201/0107* (2013.01); *A61H 2201/1671* (2013.01); *A61H 2201/1695* (2013.01)

(58) Field of Classification Search
CPC ..... A61H 15/00; A61H 15/0078; A61H 15/0085; A61H 15/0092; A61H 2015/0007–2015/0071
See application file for complete search history.

(56) References Cited

U.S. PATENT DOCUMENTS 718,594 A * 1/1903 Bailey ..... A61H 15/0092 15/201
1,724,842 A * 8/1929 Kazmazyk ..... A61H 7/00 132/212
2,168,842 A * 8/1939 Kesteven ..... A61H 15/00 482/79
2,221,785 A * 11/1940 Douglas ..... A61H 15/0092 601/120
2,376,716 A * 5/1945 Odin ..... F16B 7/105 248/407
3,636,945 A * 1/1972 Sato ..... A61H 23/0263 601/132
4,210,135 A * 7/1980 Deuser ..... A61H 7/003 601/129
4,374,519 A * 2/1983 Stauft ..... A61H 15/00 482/132
4,554,911 A * 11/1985 Nielsen ..... A61H 15/0092 132/333
5,346,449 A * 9/1994 Schlagel ..... A63B 21/0728 482/107

(Continued)

*Primary Examiner* — Michael J Tsai
*Assistant Examiner* — Christopher E Miller
(74) *Attorney, Agent, or Firm* — John A. Fortkort; Fortkort & Houston PC

(57) ABSTRACT

A device for use in physical therapy is provided. The device includes an axis, and a plurality of balls which are rotatably mounted on the axis. Each ball is equipped with a shaft through which the axis extends. The surface of the shaft is equipped with a plurality of spaced apart protrusions, and an adjustable locking feature disposed on the axis that rotatably and releasably engages the grooves formed by the spaces between the protrusions such that the distance between the balls may be adjustably fixed to any of a plurality of predetermined values.

11 Claims, 19 Drawing Sheets

(56) References Cited

U.S. PATENT DOCUMENTS 5,462,090 A * 10/1995 Winter ..... B29D 23/001 138/121
5,531,665 A * 7/1996 Chen ..... A61H 15/00 24/116 A
5,577,995 A * 11/1996 Walker ..... A61H 15/0092 601/118
5,577,996 A * 11/1996 Gardner ..... A61H 15/0092 601/118
5,580,336 A * 12/1996 Coallier ..... A63B 23/03533 473/614
5,588,953 A * 12/1996 Chang ..... A61H 15/0092 601/120
5,593,239 A * 1/1997 Sallee ..... E04H 12/182 135/114
D387,871 S * 12/1997 Childs ..... D24/211
5,823,699 A * 10/1998 Austin, Jr. ..... B25H 1/0035 403/109.1
5,843,005 A * 12/1998 Chubinsky ..... A61H 7/003 601/15
6,056,621 A * 5/2000 Lin ..... A61H 15/00 446/129
6,102,876 A * 8/2000 Winger ..... A61H 15/0092 601/107
6,299,585 B1 * 10/2001 Yoo ..... A61H 7/001 601/118
6,550,727 B2 * 4/2003 Butterfield ..... B62D 1/184 248/188.5
6,878,124 B1 * 4/2005 Crowe ..... A61H 15/0092 601/119
6,974,427 B1 * 12/2005 Lapham ..... A61H 15/00 601/120
7,223,251 B1 * 5/2007 Cassidy Phillips ..... A61H 15/0092 601/118
2003/0009116 A1 * 1/2003 Luettgen ..... A61H 19/34 601/46
2004/0261554 A1 * 12/2004 Tylosky ..... F16B 7/06 74/89.39
2008/0004553 A1 * 1/2008 Tsai ..... A61H 15/0092 601/120
2008/0103421 A1 * 5/2008 Nicholson ..... A61H 15/0092 601/120
2010/0191161 A1 * 7/2010 Mouatt ..... A61H 7/001 601/137
2011/0257569 A1 * 10/2011 Robins ..... A61H 15/00 601/137
2011/0301000 A1 * 12/2011 Pullen ..... A61H 1/0281 482/109
2011/0313333 A1 * 12/2011 Nicholson ..... A61H 15/0092 601/120
2012/0238925 A1 * 9/2012 Winkley ..... A61H 7/001 601/118
2012/0309593 A1 * 12/2012 Smith ..... A63B 23/16 482/49
2013/0066245 A1 * 3/2013 Dagan ..... A61H 7/003 601/118
2013/0096472 A1 * 4/2013 Bertram ..... A61H 15/0092 601/120
2013/0158455 A1 * 6/2013 Ruschmeyer ..... A61H 15/00 601/118
2013/0178768 A1 * 7/2013 Dalebout ..... A61H 15/0092 601/46
2013/0190664 A1 * 7/2013 Johnson ..... A61H 15/0092 601/129
2014/0024984 A1 * 1/2014 Allen ..... A61H 7/007 601/134
2014/0114221 A1 * 4/2014 Indermill ..... A61H 15/00 601/120
2015/0374576 A1 * 12/2015 Dagan ..... A61H 7/003 601/119

* cited by examiner

Fig. 7a Fig. 7b Fig. 7c Fig. 7d Fig. 7e
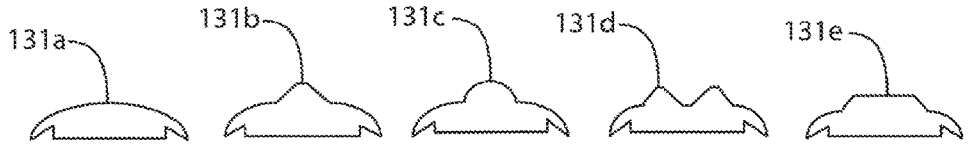
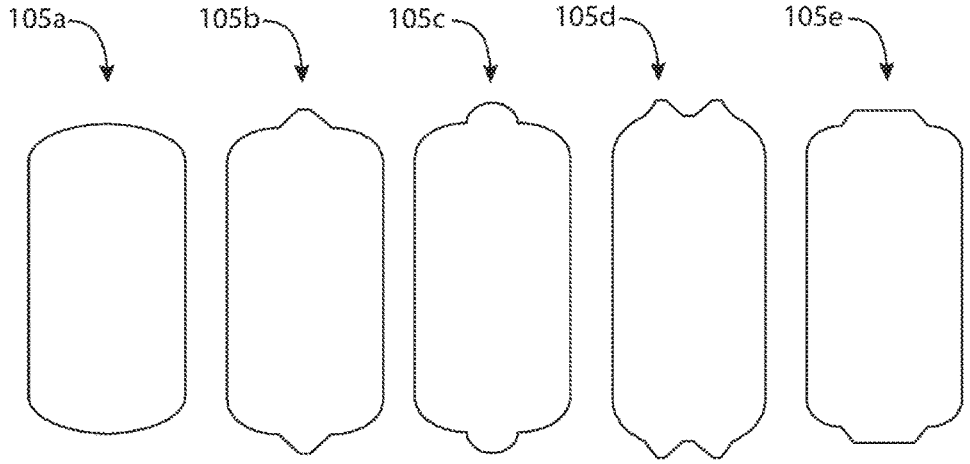
Fig. 7f Fig. 7g Fig. 7h Fig. 7i Fig. 7j
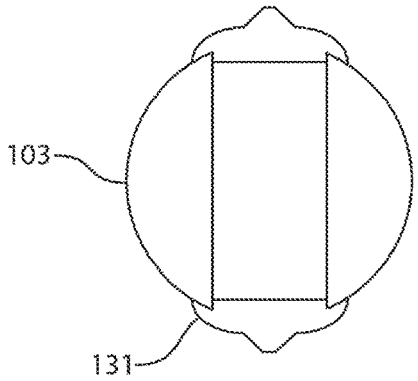
Fig. 7k
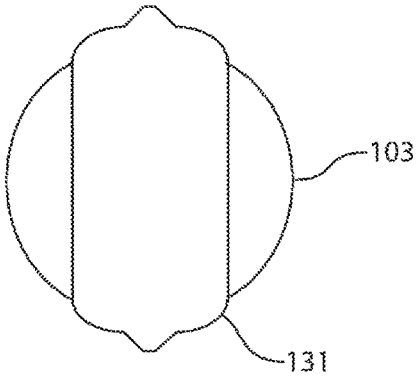
Fig. 7l

DEVICES AND METHODOLOGIES FOR PHYSICAL THERAPY AND WELL BEING

CROSS-REFERENCE TO RELATED APPLICATIONS

This application claims the benefit of U.S. Provisional Application No. 61/786,399, filed Mar. 15, 2013, having the same title, and which is incorporated herein by reference in its entirety; and also claims the benefit of U.S. Provisional Application No. 61/786,468, filed Mar. 15, 2013, which is incorporated herein by reference in its entirety; and also claims the benefit of priority of U.S. Provisional Application No. 61/802,040, filed Mar. 15, 2013, which is incorporated herein by reference in its entirety.

FIELD OF THE DISCLOSURE

The present disclosure relates generally to physical therapy, and more particularly to devices which are useful in physical therapy and to methods for using the same.

BACKGROUND OF THE DISCLOSURE

Various devices have been developed for use in physical therapy, or as accessories for use in physical exercise or training. However, many of these devices are limited to a specific use or effect. As a practical matter, it is difficult and expensive for a physical therapist to maintain and use a wide range of tools directed to different uses or effects.

BRIEF DESCRIPTION OF THE DRAWINGS

FIG. 7 illustrates the use of bands to impart various profiles to rollers in the therapeutic devices disclosed herein.

SUMMARY OF THE DISCLOSURE

In one aspect, a device is provided which is useful in physical therapy. The device comprises (a) an axis; (b) a plurality of balls rotatably mounted on said axis, wherein each ball is equipped with a shaft through which said axis extends, and wherein the surface of said shaft is equipped with a plurality of spaced apart protrusions; and (c) an adjustable locking feature disposed on said axis that rotatably and releasably engages the grooves formed by the spaces between said protrusions such that the distance between said balls may be adjustably fixed to any of a plurality of predetermined values.

In another aspect, a device is provided which is useful in physical therapy. The device comprises (a) a handle equipped with a first connector; and (b) a ball which is releasably attached to said handle by way of said first connector.

In a further aspect, a method for treating soft tissue is provided. The method comprises (a) providing a tool which includes a ball mounted on a handle; (b) using the handle to position the ball against a soft tissue mass; and (c) pressing the ball against the soft tissue mass.

DETAILED DESCRIPTION

It has now been found that the foregoing issues may be overcome by some of the devices and methodologies disclosed herein. In a preferred embodiment, a set of therapeutic devices are disclosed herein which are modular in the sense that different accessories, surfaces or attachments may be added to these devices, each of which may be directed to a specific use or effect. Consequently, a physical therapist may use these devices for a wide range of applications. In a preferred embodiment, members of the set of therapeutic devices are combinable so that the number of a certain feature, such as, for example, roller balls, may be readily adjusted by the user, thus optimizing the device for a particular use or patient.

Figure 1:
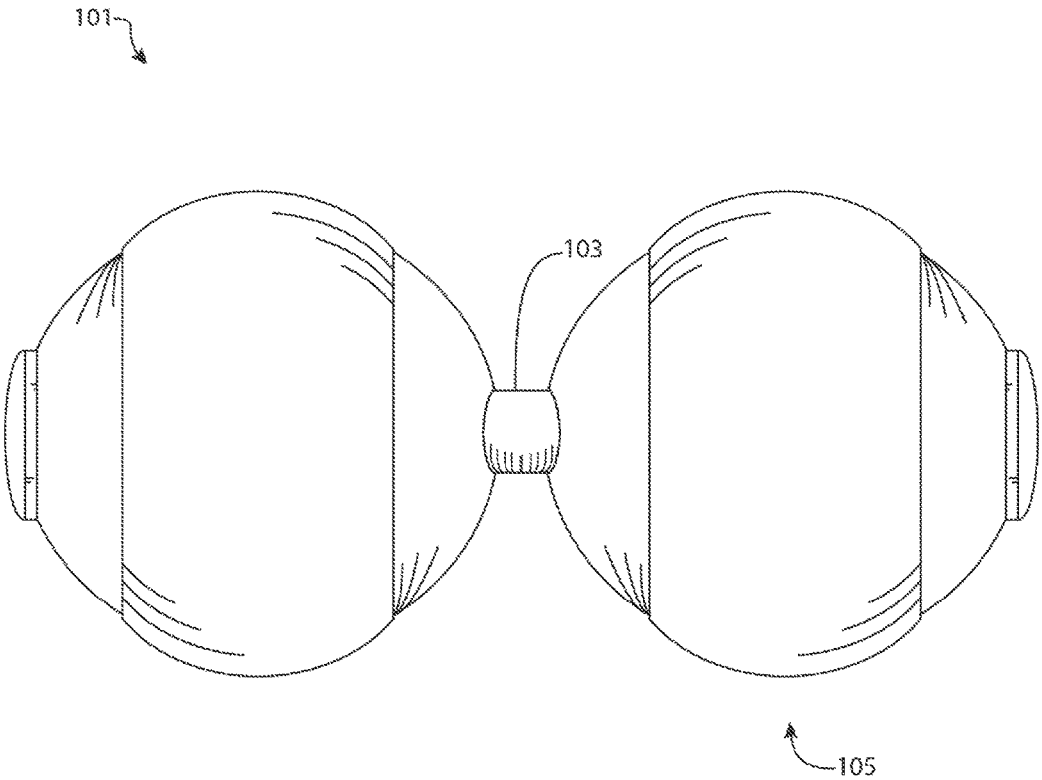
FIG. 1 is an illustration of a first embodiment of a therapeutic device in accordance with the teachings herein.
Figure 2:
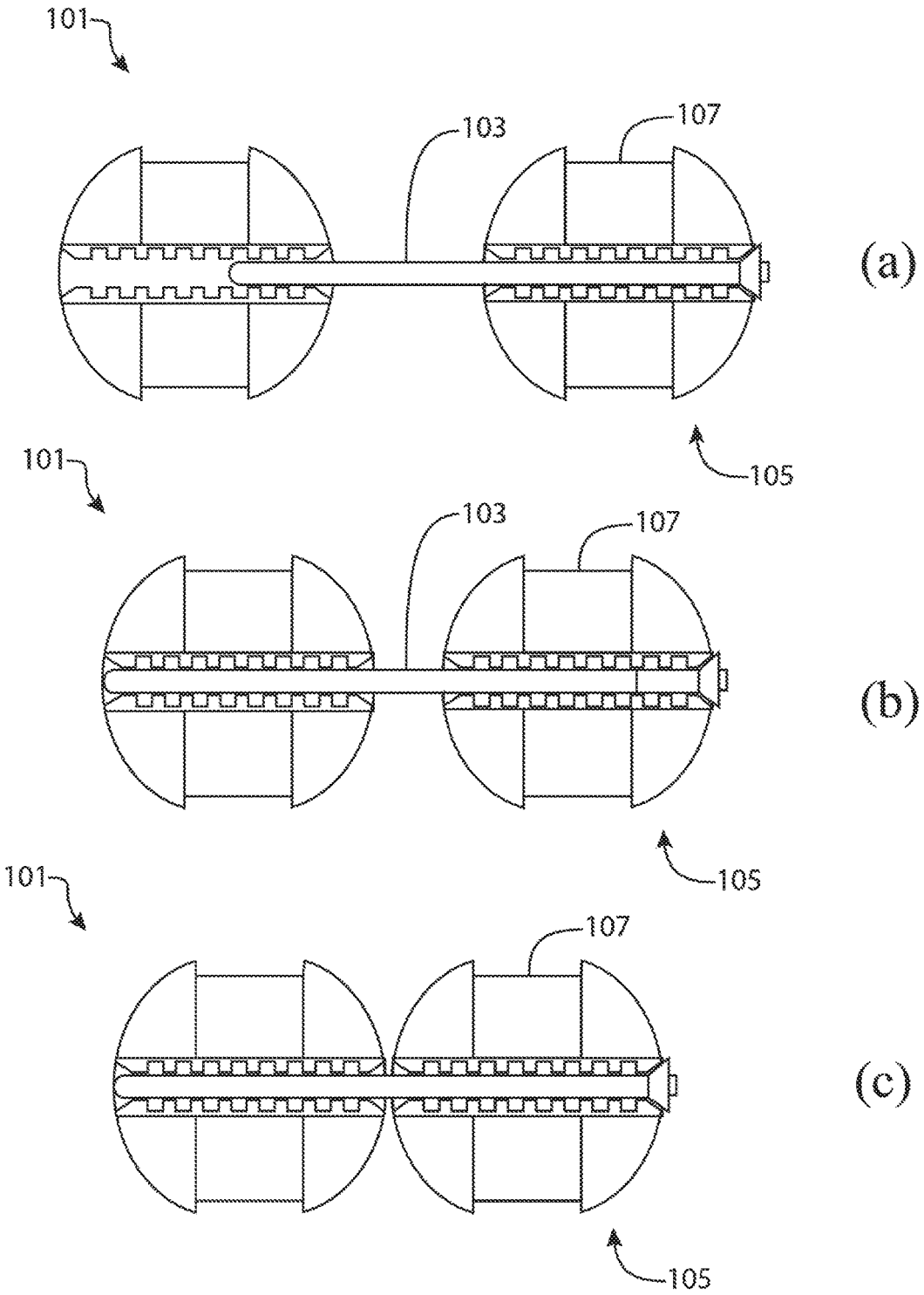
FIGS. 2-4 illustrate the construction of the embodiment of FIG. 1.

A first particular, non-limiting embodiment of a therapeutic device in accordance with the teachings herein is depicted in FIGS. 1-2. As seen therein, the therapeutic device 101 in this particular embodiment comprises a longitudinal shaft 103 with a plurality of rollers 105 rotatably disposed thereon. The rollers 105 in this particular embodiment are essentially spherical, are independently rotatable, and are equipped with a central groove 107. The spacing of the rollers 105 may be adjusted along the longitudinal axis of the shaft 103, preferably in predefined increments as described below. The rollers may comprise various materials, including wood, metal, plastic, or rubber (including high density foamed rubbers).

Figure 3:
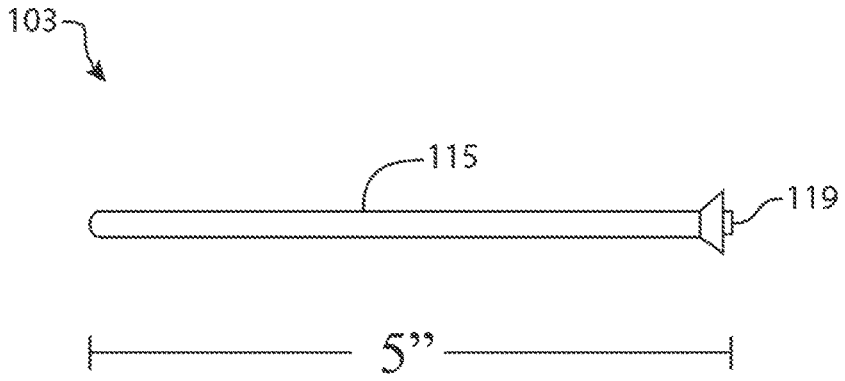

FIG. 3 depicts the shaft 103 in greater detail. As seen therein, the shaft 103 has a longitudinally extending body 115 that is generally cylindrical in shape. The shaft 103 is equipped on a first end with one or more protrusions 117 which are at least partially retractable into the interior of the shaft, and is equipped on the other end with a release button 119. The release button 119 manipulates the protrusions 117 between a first retractable state in which they are partially or wholly withdrawn into the body 115 of the shaft 103, and a second protruding state in which they extend from the body 115 of the shaft.

Figure 4:
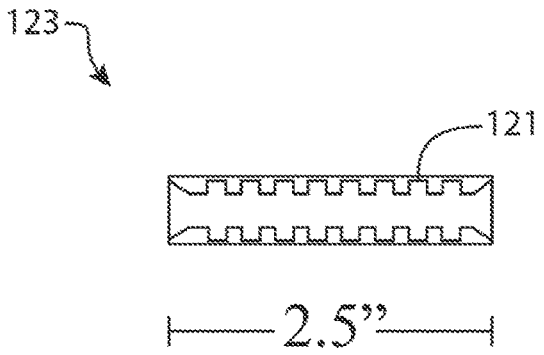

As seen in FIG. 4, when the protrusions 117 are in the second state, they engage a series of annular indentations 121 provided in the axle 123 of the rollers 105, thus maintaining the rollers 105 in a fixed position along the length of the body 115 of the shaft 103. The indentations 121 are preferably radial, thus allowing the rollers 105 to rotate freely about the longitudinal axis of the shaft 103.

Figure 5:
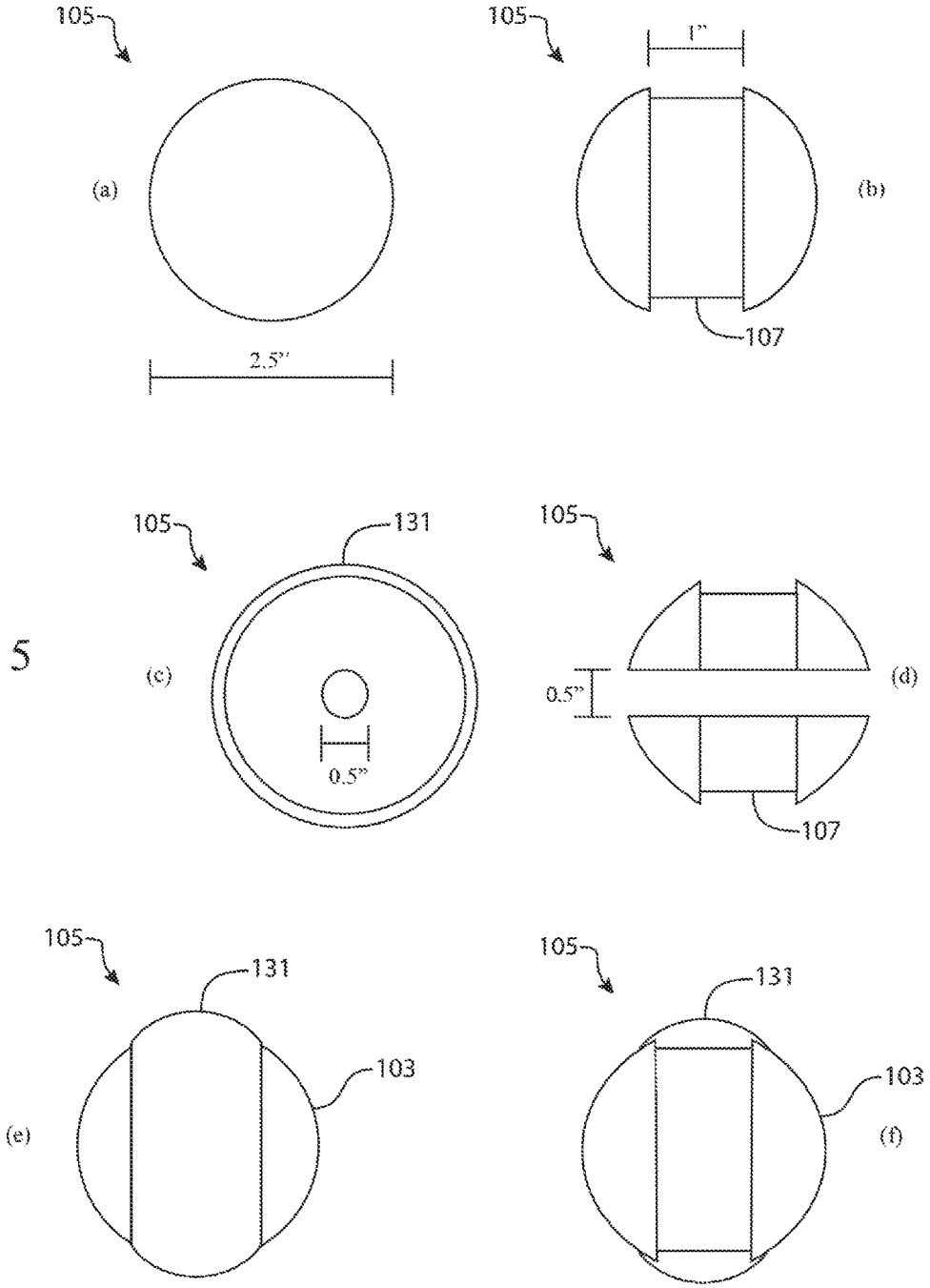
FIGS. 5-6 illustrates the construction of a roller of the embodiment of FIG. 1
Figure 6:
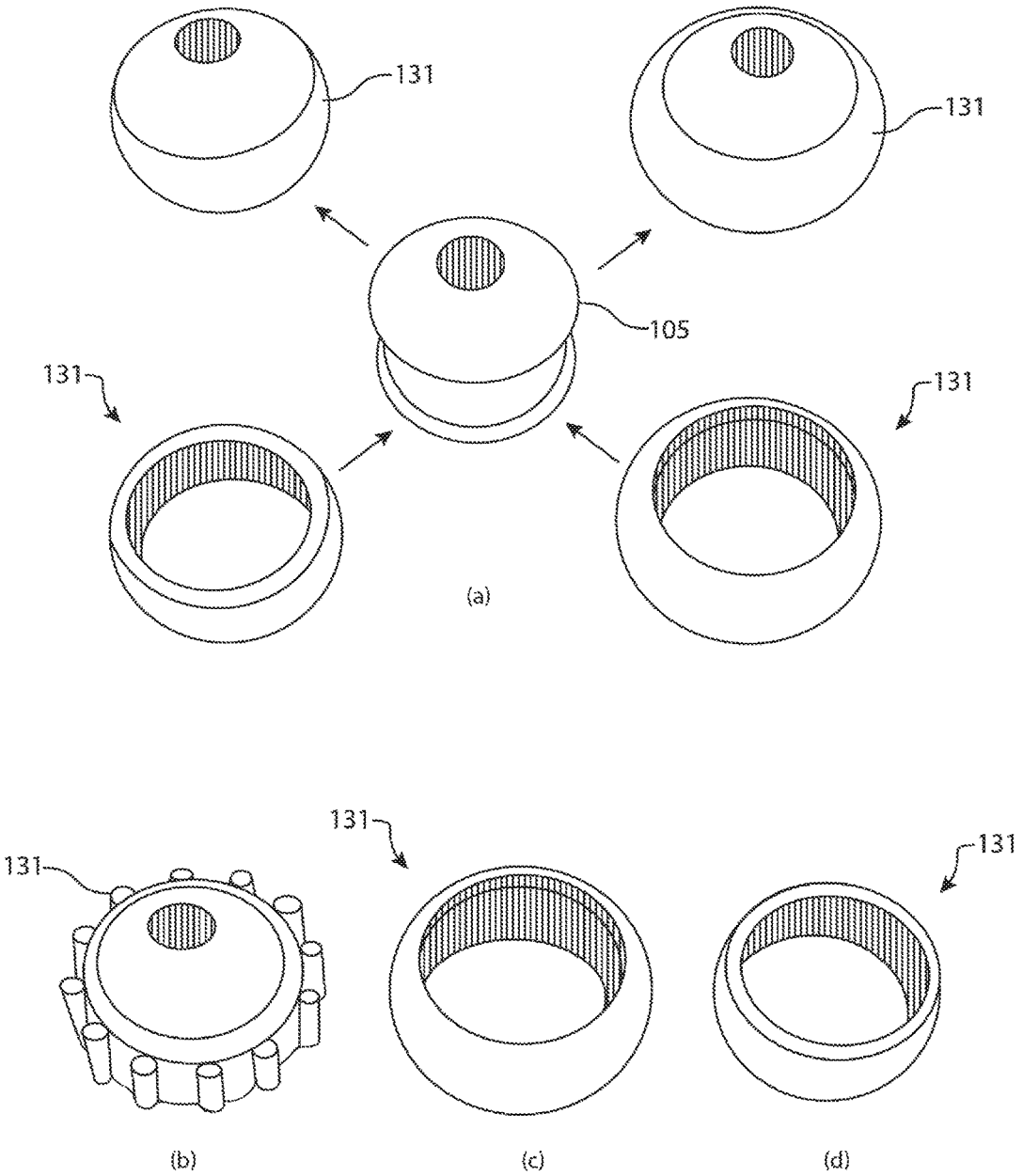

As seen in FIGS. 5-6, a variety of bands 131 are provided that are removably seatable in the central groove 107 of each roller 105. Preferably, the bands 131 comprise an elastomeric material so that they can be stretched into place in the central groove 107, after which the compressive force of the elastomer will hold them in place. Various elastomers may be utilized for this purpose, although the use of silicone and neoprene rubbers is especially preferred. These materials may be compounded with various fillers, pigments or dyes, and may have various textures imparted to their surfaces. These materials may also be presented as closed-cell or open-cell foams.

As shown in FIG. 7, the outer surface of the bands 131 may be equipped with various surface features or profiles that may be designed for specific purposes or applications (the cross-sectional profile of the band 131 on each corresponding roller 105*a-e* is depicted above the corresponding roller). Thus, the band 131*a* in FIG. 7*a* has a rounded profile that is symmetrical about a plane that bisects the band 131*a* and is orthogonal to the axis of rotation of the roller 105. The band 131*b* of FIG. 7*b* has a profile which is similar to that of FIG. 5*a*, except that it is equipped with a radial protrusion 133*b* that has its apex along the aforementioned bisecting plane. In the band 131*c* of FIG. 7*c*, the radial protrusion 133 in the band 133*b* of 7*b* has been replaced with a set of equally spaced and approximately hemispherical protrusions 133*c*. In the band 131*d* of FIG. 7*d*, the radial protrusion 133*b* in the band 131*b* of 5*b* has been replaced with a pair of spaced apart radial protrusions 133*d*. In the band of FIG. 7*e*, the radial protrusion 133*b* in the band 131*b* of 7*b* has been replaced with a series of lateral, spaced apart protrusions 133*e* that are parallel to the axis of rotation of the roller 105.

Figure 8:
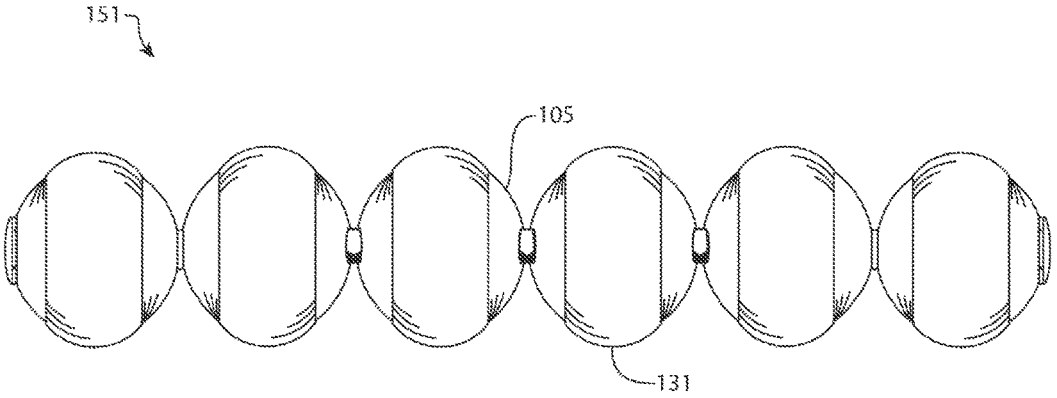
FIGS. 8-12 illustrate various configurations for the therapeutic devices disclosed herein.
Figure 9:
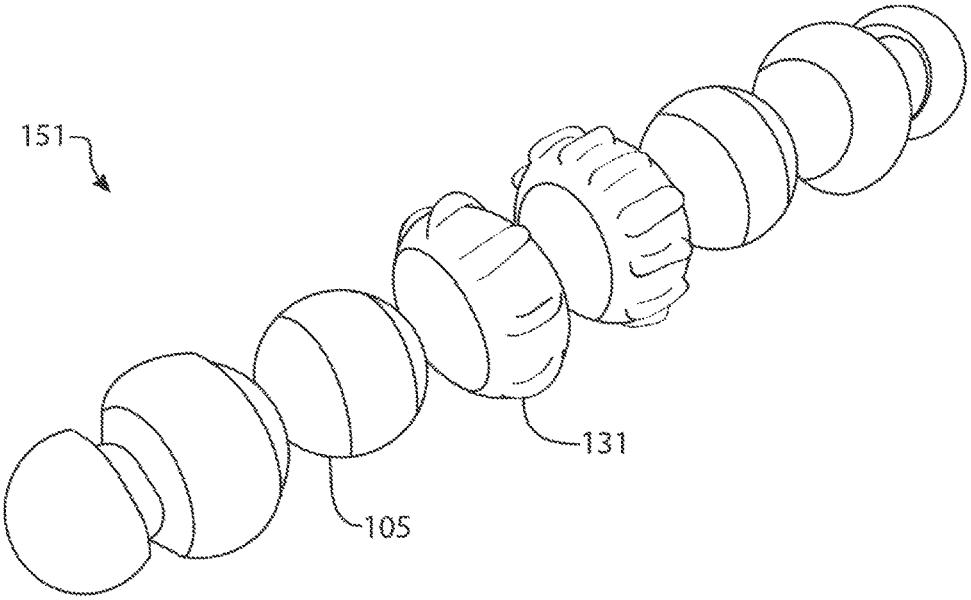
Figure 10:
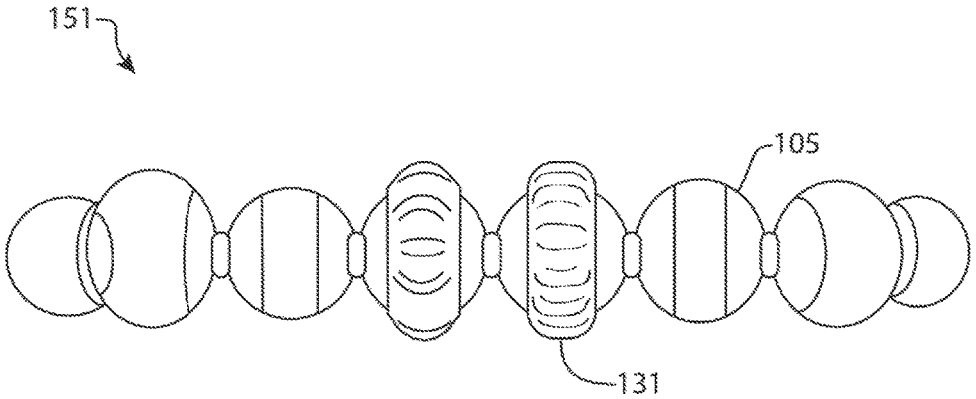

As seen in FIGS. 8-10, in some embodiments, the therapeutic device of FIG. 1 may be expandable to accommodate additional rollers 105, and the band 131 associated with each roller 105 may be independently selected. Thus, the therapeutic device 151 of FIG. 8 features 6 rollers 105, the bands 131 of which all have the same profile. By contrast, in the therapeutic device 151 of FIGS. 9-10, which is also equipped with 6 rollers 105, the rollers feature bands 153*a*, 153*b* and 153*c* with three different profiles. The therapeutic device 151 of FIGS. 9-10 is also equipped with foamed end caps 155, which may be advantageous, for example, in applications where it is desirable that the device not have any hard surfaces that can come into contact with the body.

Figure 11:
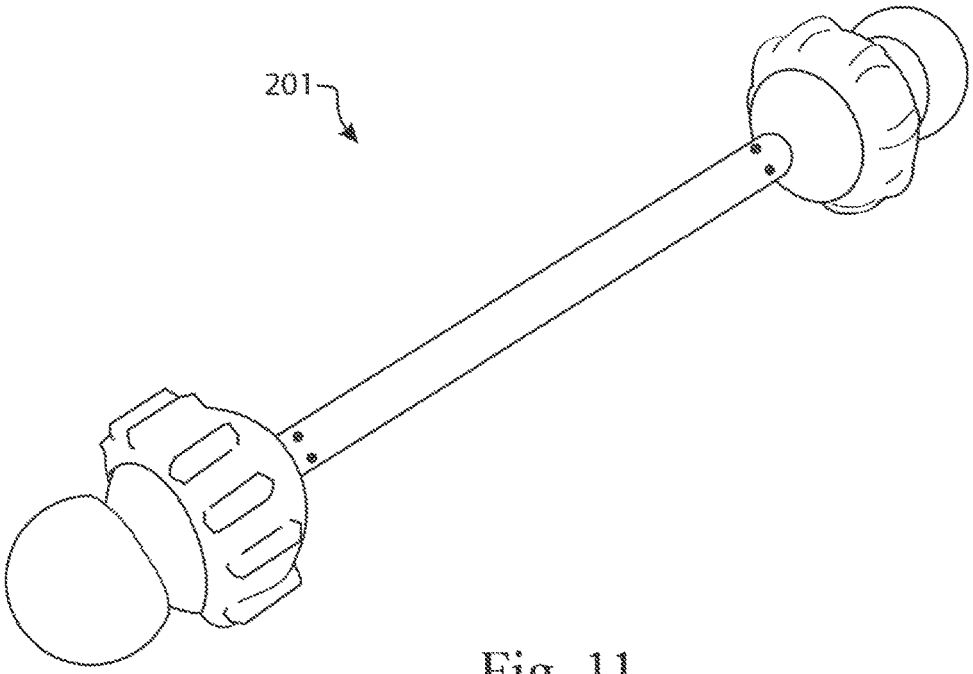
Figure 12:
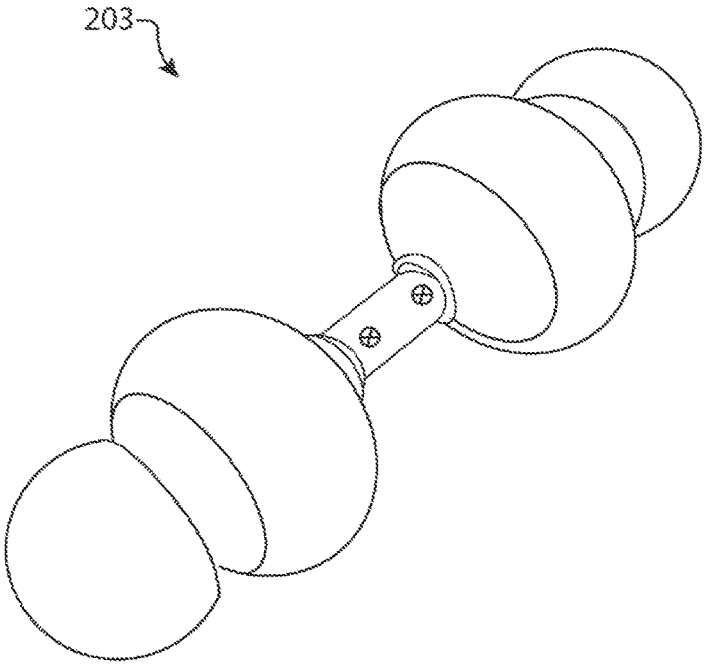

As seen in FIGS. 11-12, the therapeutic devices disclosed herein are adjustable into several configurations. Thus, the therapeutic device 201 of FIG. 11 is shown in an expanded configuration, while the therapeutic device 203 of FIG. 11 is shown in a contracted configuration.

Figure 13:
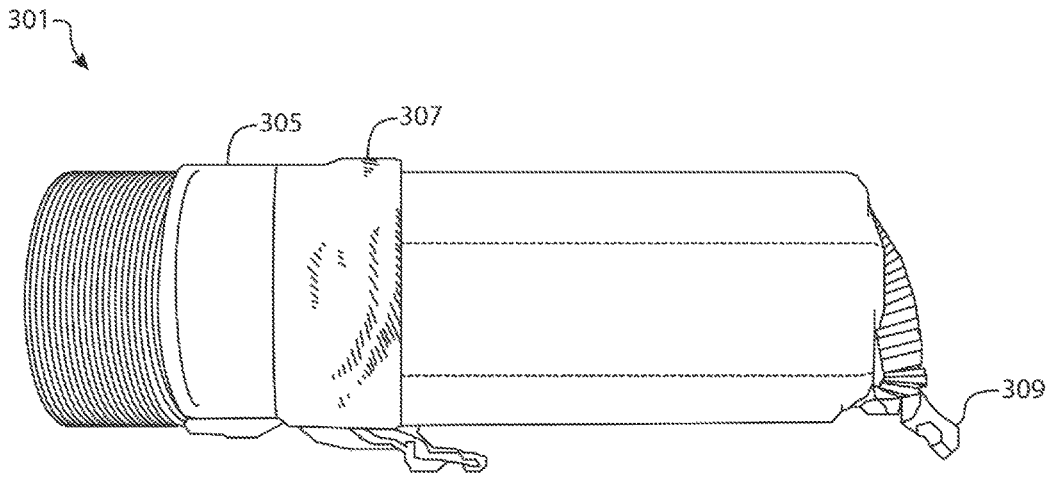
FIGS. 13-15 illustrate a kit containing the therapeutic devices disclosed herein.
Figure 14:
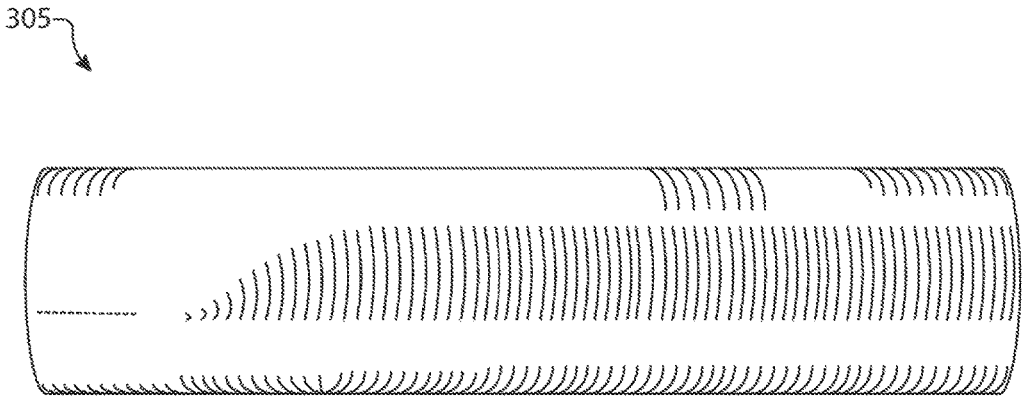
Figure 15:
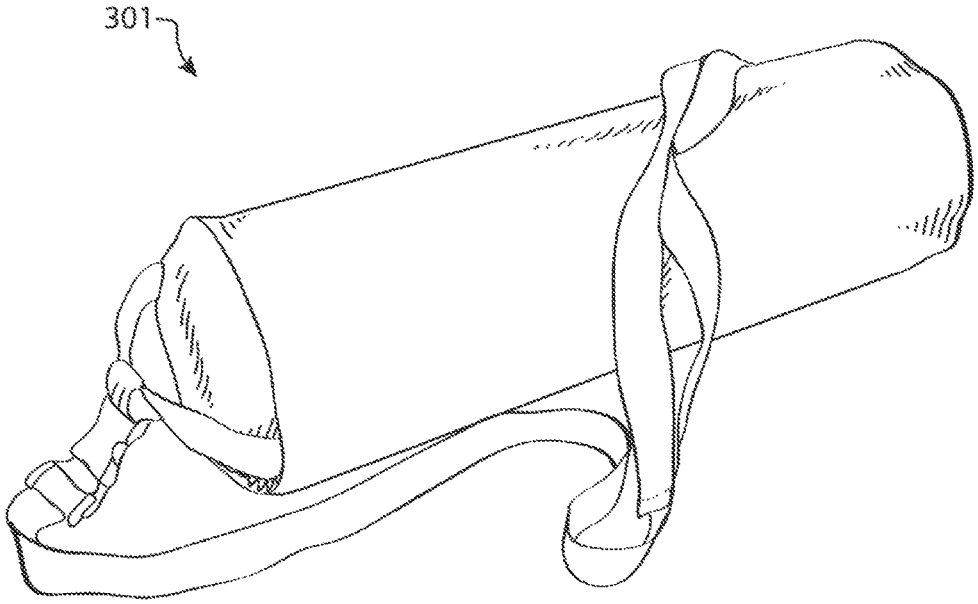

As seen in FIGS. 13-15, the therapeutic devices disclosed herein may be produced as part of a kit 301. In a preferred embodiment, this kit 301 includes a tube 303 within which the therapeutic device is placed, a matt 305 which is wrapped around the external surface of the tube 303, and a carrying bag 307 into which the therapeutic device, tube 303 and matt 305 may be inserted. The tube 303 may comprise plastic, metal or rubber. The matt is preferably a workout or yoga matt, and may comprise foamed rubber or plastic. The carrying bag 307 preferably comprises nylon, canvas or cloth, but may comprise virtually any material, and is preferably equipped with one or more straps 309, clips or other accessories to facilitate carrying it.

Various types of shafts may be utilized in the therapeutic devices disclosed herein. In a preferred embodiment, the shaft comprises a male element or pin which releasably couples with a female element or pin. However, in some applications, as where an extended shaft is desired (e.g., for the incorporation of additional rollers), an extender may also be utilized. In such embodiments, the extender may have male and female features which releasably couple, respectively, with the aforementioned male and female elements to provide an extended shaft. Alternatively, the extender may have two sets of female features which releasably couple with two male elements, or two sets of male features which releasably couple with two female elements.

Figure 16:
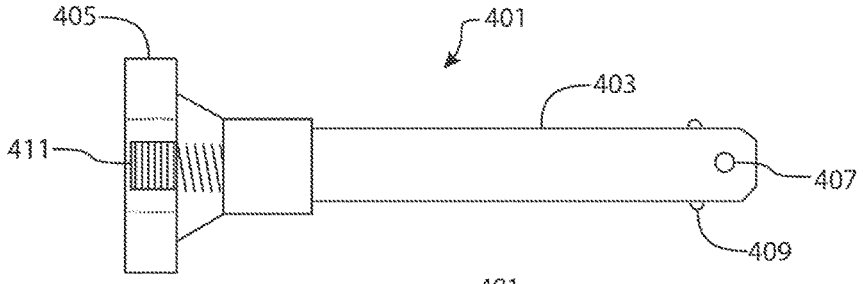
FIGS. 16-25 illustrate various embodiments of pins and extenders for use in constructing therapeutic devices in accordance with the teachings herein.
Figure 17:
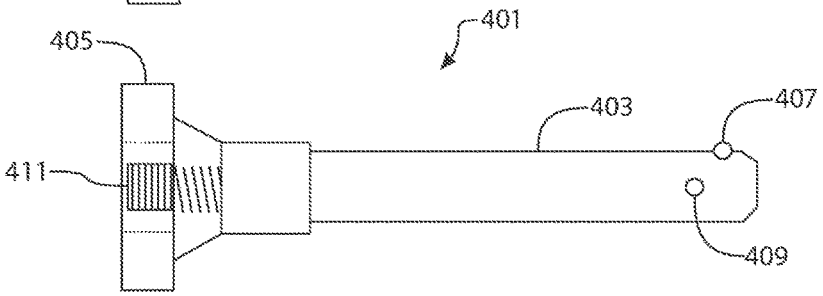

FIGS. 16-17 depict one particular embodiment of a pin 401 that may be utilized in the construction of therapeutic devices in accordance with the teachings herein. The pin 401 depicted therein has a shaft 403 which is equipped on one end with a head 405, and which is equipped on the opposing end with a ball key 407 and a set of protrusions 409. As described below, the ball key 407 may be utilized to key the pin 401 to an extender (not shown), while the set of protrusions 409 releasably engage a series of apertures in the extender. The head 405 of the pin 401 is equipped with a spring-activated button 411 which causes the set of protrusions 409 to retract when the button 411 is pressed, thus allowing the pin 401 to be adjusted.

Figure 18:
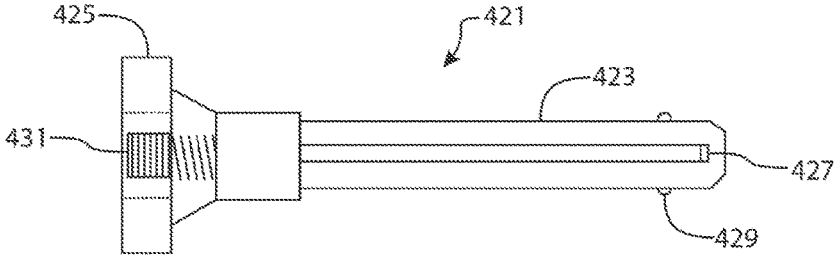
Figure 19:
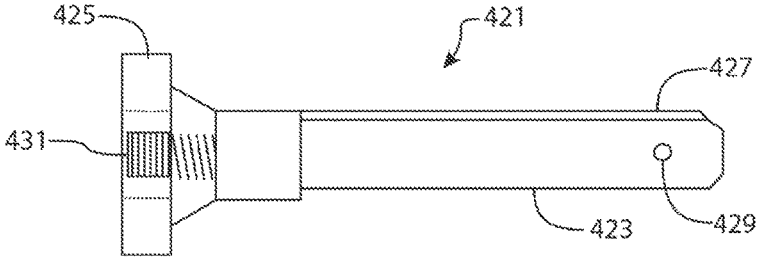

FIGS. 18-19 depict another particular embodiment of a pin 421 that may be utilized in the construction of therapeutic devices in accordance with the teachings herein. The pin 421 depicted therein has a shaft 423 which is equipped on one end with a head 425, and which is equipped on the opposing end with a set of protrusions 429. A longitudinally extending ridge 427 is provided on the shaft 423. As described below, the ridge 427 may be utilized to key the pin 421 to an extender (not shown), while the set of protrusions 429 releasably engage a series of apertures in the extender. The head 425 of the pin 421 is equipped with a spring-activated button 431 which causes the set of protrusions 429 to retract when the button 431 is pressed, thus allowing the pin 421 to be adjusted.

Figure 20:
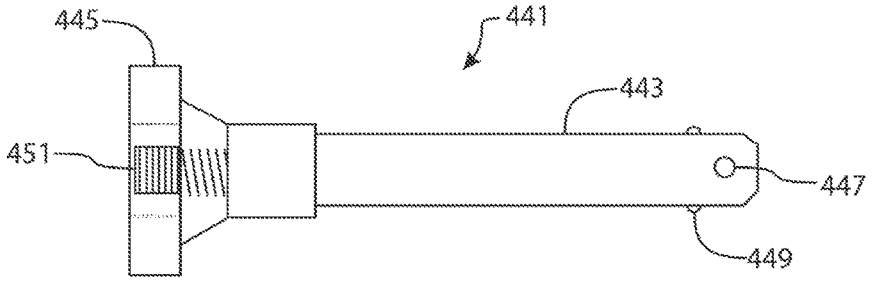
Figure 21:
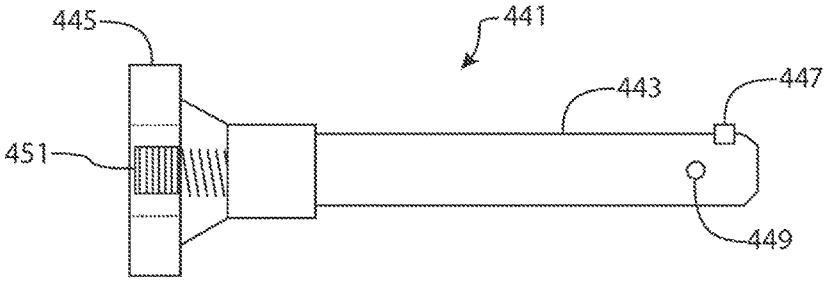

FIGS. 20-21 depict another particular embodiment of a pin 441 that may be utilized in the construction of therapeutic devices in accordance with the teachings herein. The pin 441 depicted therein has a shaft 443 which is equipped on one end with a head 445, and which is equipped on the opposing end with a screw-in key 447 and a set of protrusions 449. As described below, the screw-in key 447 may be utilized to key the pin 441 to an extender (not shown), while the set of protrusions 449 releasably engage a series of apertures in the extender. The head 445 of the pin 441 is equipped with a spring-activated button 451 which causes the set of protrusions 449 to retract when the button 451 is pressed, thus allowing the pin 441 to be adjusted.

Figure 22:
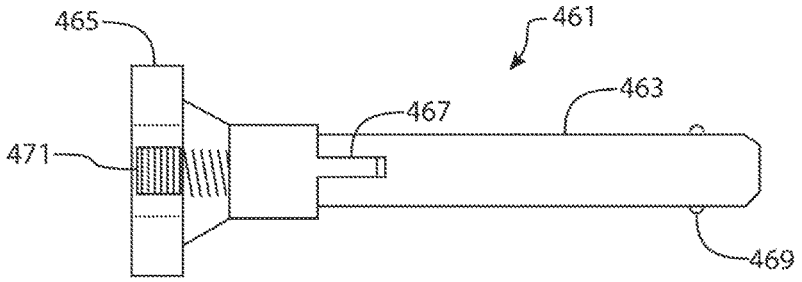
Figure 23:
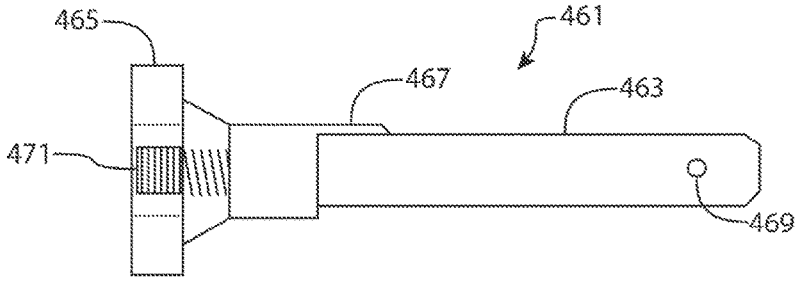

FIGS. 22-23 depict another particular embodiment of a pin 461 that may be utilized in the construction of therapeutic devices in accordance with the teachings herein. The pin 461 depicted therein is similar to the pin 421 of FIGS. 18-19, but has a shorter ridge. Thus, the pin 461 has a shaft 463 which is equipped on one end with a head 465, and which is equipped on the opposing end with a set of protrusions 469. A longitudinally extending ridge 467 is provided on the shaft 463. As described below, the ridge 467 may be utilized to key the pin 461 to an extender (not shown), while the set of protrusions 469 releasably engage a series of apertures in the extender. The head 465 of the pin 461 is equipped with a spring-activated button 471 which causes the set of protrusions 469 to retract when the button 471 is pressed, thus allowing the pin 461 to be adjusted.

Figure 24:
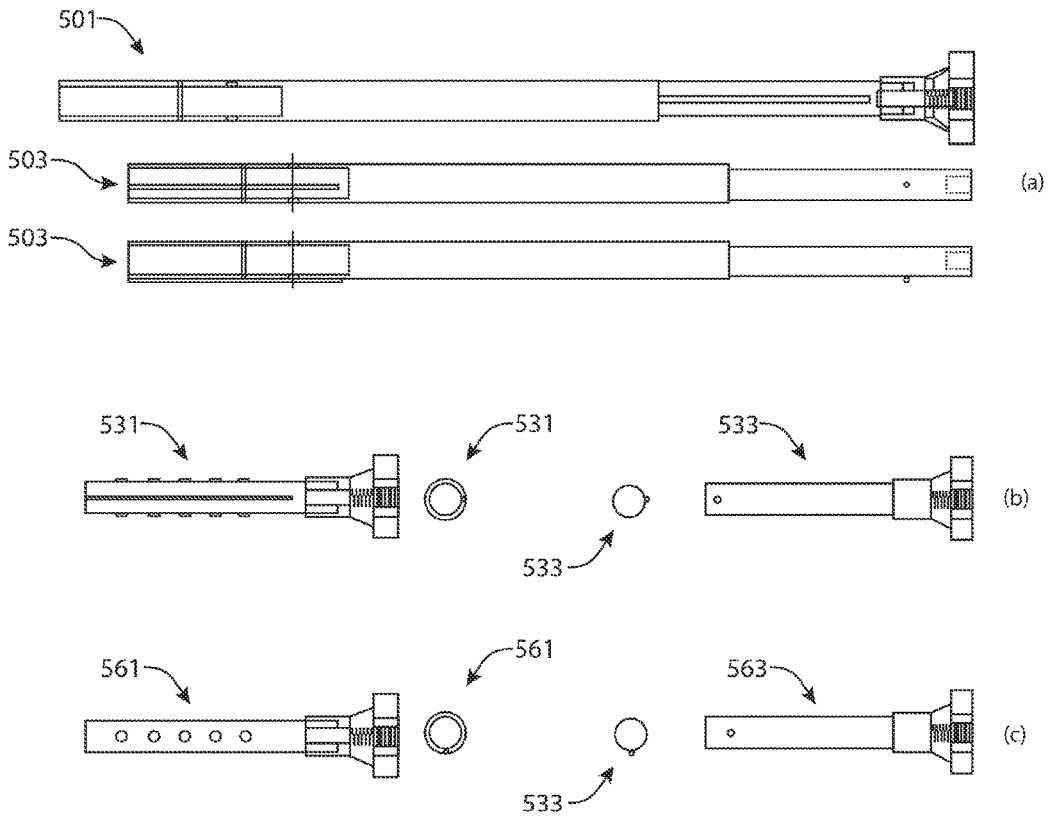
Figure 25:
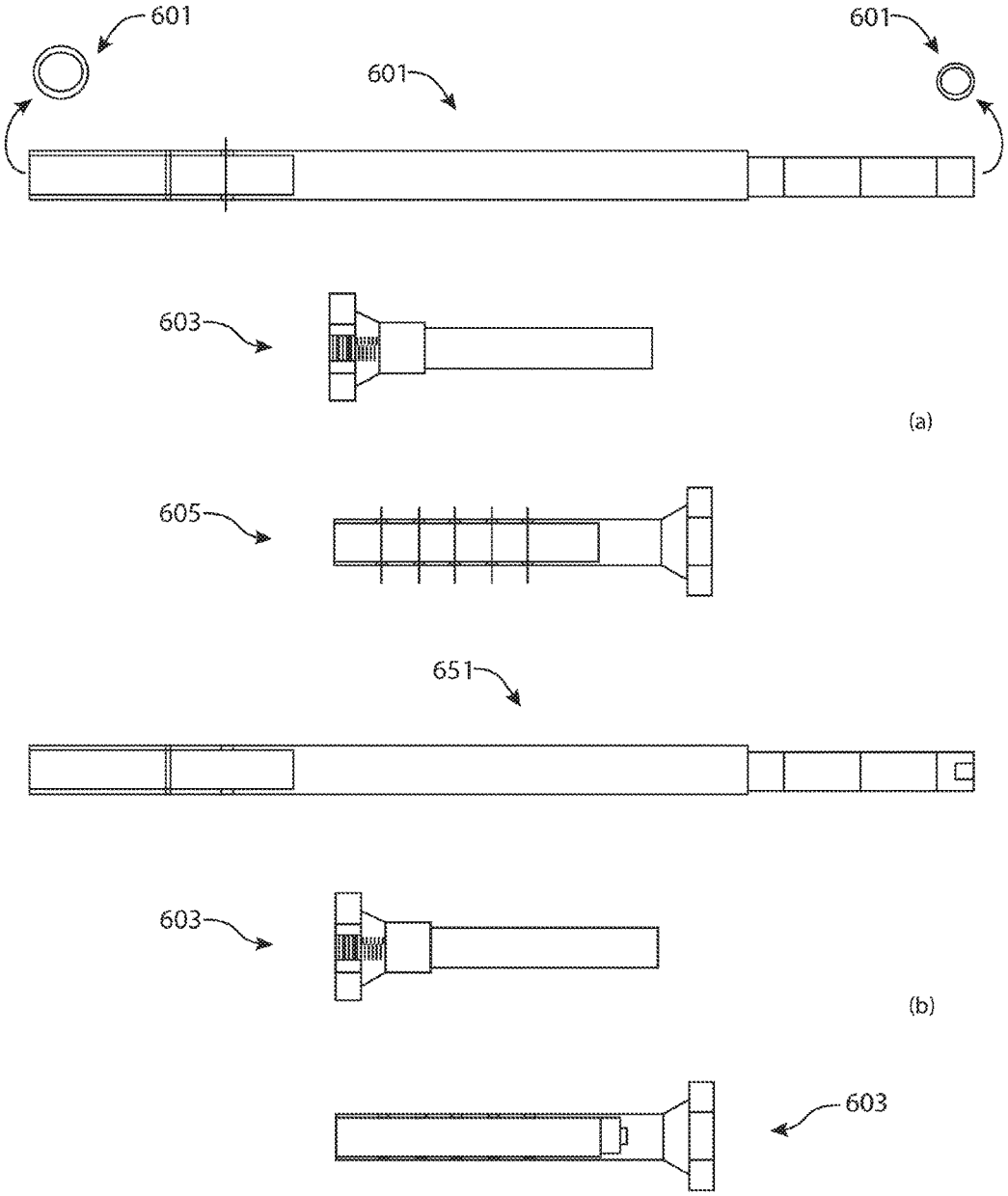

FIGS. 24-25 illustrate the manner in which the pins described above may be releasably mated with an extender to produce a shaft.

For purposes of brevity, a detailed description of some aspects of the therapeutic devices disclosed herein, such as their use in physical therapy or exercise, has been omitted. However, these details may be found in the following publications produced by the present inventors and accessible on www.youtube.com, all of which are incorporated herein by reference in their entirety:

(a) Dual Ball Thoracic Spine:
(b) Dual Ball Adjustment;
(c) General Set-up of MOBO;
(d) Supine Trapezius Mobilization;
(e) Ball & Stick Pec Release/Posterior Rib Mobilization;
(f) Dual Ball Suboccipital Release;
(g) Dual Ball Thoracic Extension III;
(h) Dual Ball Thoracic Extension II;

(i) Dual Ball Calf Roll;
(j) Dual Ball with TRX;
(k) 6 Ball Seated Roller;
(l) 6 Ball Roller ITB/calf;
(m) MOBO Overview;
(n) MOBO Overview Long;
(o) Standing Pec/Middle Trap/Posterior Rib Mobilization;
(p) Posterior Rib/Middle Trap Mobilization;
(q) Hands Free Trap Mobilization.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

What is claimed is:

1. A device for physical therapy, comprising:

an axis;

a plurality of balls rotatably mounted on said axis, wherein each ball is equipped with a shaft through which said axis extends, and wherein a surface of said shaft is equipped with a plurality of spaced apart protrusions; and an adjustable locking feature disposed on said axis that rotatably and releasably engages grooves formed by spaces between said protrusions such that the length of the device in the longitudinal direction of said axis is adjustable to any of a plurality of fixed, predetermined values;

wherein each ball is equipped with an annular indentation, and wherein said axis is a ball lock pin.

2. The device of claim 1, wherein said lock pin is equipped with a button on one end thereof, and wherein pressing the button causes a set of balls on the pin to retract into a shank of the pin.

3. The device of claim 2, further comprising a plurality of bands, wherein each of said plurality of bands is adapted to fit securely within one of said annular indentations.

4. The device of claim 3, wherein one of said plurality of bands is disposed in each of said indentations.

5. A kit comprising the device of claim 1 and a plurality of bands, wherein each of said plurality of bands is adapted to fit securely within one of said annular indentations.

6. The kit of claim 5, wherein said plurality of bands comprises a first band having a first surface profile, and a second band having a second surface profile which is distinct from said first surface profile.

7. The kit of claim 6, wherein at least one of said first and second surface profiles includes an annular ridge.

8. The kit of claim 6, wherein at least one of said first and second surface profiles includes a plurality of rounded protrusions.

9. The kit of claim 6, wherein at least one of said first and second surface profiles includes first and second annular ridges.

10. The kit of claim 6, wherein at least one of said first and second surface profiles includes a plurality of lateral ridges.

11. The device of claim 1, wherein said axis is a threaded fastener.

* * * * *